United States Patent [19]

Smith

[11] 4,449,076

[45] May 15, 1984

[54] LIGHT ISOLATED PILOT LIGHT

[75] Inventor: Enoch P. Smith, Greendale, Wis.

[73] Assignee: Allen-Bradley Company, Milwaukee, Wis.

[21] Appl. No.: 359,267

[22] Filed: Mar. 18, 1982

[51] Int. Cl.[3] ..... H05B 37/00

[52] U.S. Cl. ..... 315/312; 315/150; 315/134; 324/414; 340/641

[58] Field of Search ..... 315/134, 152, 250, 254, 315/312, 313, 150; 340/641, 642; 324/414

[56] References Cited

U.S. PATENT DOCUMENTS

| | | | |
|---|---|---|---|
| 3,493,760 | 2/1970 | Hoadley | 250/551 |
| 3,739,334 | 6/1973 | Hocking | 340/334 |
| 3,938,000 | 2/1976 | Higashide | 315/205 |
| 4,019,128 | 4/1977 | Chebowski | 324/21 |

OTHER PUBLICATIONS

Dual Input Pilot Lights, Product Data Sheet 800T, Jul. 1975, Allen Bradley Co.

*Primary Examiner*—Harold Dixon
*Attorney, Agent, or Firm*—Quarles & Brady

[57] ABSTRACT

A pilot light as might be used for monitoring an industrial control circuit having a normal signal circuit connectable to a control circuit element for illuminating a lamp of the pilot light when such control circuit element is operated, and also having a test circuit connectable to a test switch for testing the integrity of the lamp when the test switch is operated. A circuit for supplying current to the lamp is light coupled to both the normal signal circuit and the test circuit.

6 Claims, 4 Drawing Figures

LIGHT ISOLATED PILOT LIGHT

BACKGROUND OF THE INVENTION a. Field of the Invention

The present invention relates to pilot lights as used in monitoring industrial control circuits.

b. The Prior Art

It is common in electrical control circuits to have a large number of switches such as motor starters, limit switches, float switches, thermal switches and the like integrated into a complex circuit for controlling a line of machines or an industrial process. It is desirable to visually monitor the switching functions of the circuit, and for this purpose large numbers of pilot lights connected into the control circuit may be mounted on a control panel for visually displaying switch conditions by illuminating the respective pilot lights as associated switching takes place. Such pilot lights usually comprise individual units each with its own housing, lamp and terminals for connection into the control circuit. In some constructions a transformer also may be included in the housing to reduce the lamp voltage from the control circuit voltage.

The lamps of pilot lights are subject to failure, and burned out lamps can give false indications of circuit conditions by failing to illuminate when an associated switching function occurs. Thus, it is common to include a test circuit with the pilot lights to enable the simultaneous testing of an entire group of pilot lights by operation of a single test button. Pilot lights adapted for such testing may be called remote test pilot lights and they are characterized by the addition of test terminals and internal components that apply a test voltage to the lamp whenever the remotely located test button is operated. The internal components function to electrically isolate the test terminals from the normal signal terminals of the pilot light, so that voltages applied to one set of terminals do not feed back into the circuitry of the other set of terminals. However, the internal components that isolate the test terminals from the regular signal terminals are themselves subject to failure, and in some instances failures can cause malfunctions in the control circuits which the pilot lights monitor. For example, in some pilot lights diodes are inserted between a signal terminal and a test terminal to block voltages in the test circuit from feeding into the signal circuit being monitored, and to conversely block voltages in the monitored signal circuit from the test circuit. Such diodes may fail by shorting through their junctions, and the blocking function is then lost, with the result that voltages can be improperly fed between test and signal circuits. It thus becomes desirable to employ extra protective devices in circuit with the diodes to maintain isolation between the test and signals terminals.

Another consideration in pilot light design is the desirableness of using low voltage lamps, say of the order of 6.3 volts. The filaments of low voltage lamps are sturdier and can better withstand shock and vibration than the thinner filaments of higher voltage lamps. Also, low voltage lamps can safely be replaced by maintenance personnel without any necessity to deenergize the circuits to which the pilot lights are connected. To use low voltage lamps, it is usual practice to incorporate a transformer in a pilot light with the lamp connected across the low voltage secondary, but in pilot lights using diode isolation this is not practical for the reason the diodes would supply pulsating direct current to the transformer primary, making the transformer too inefficient for commercial practices. Hence, available diode type remote test pilot lights have not used low voltage lamps, except for special constructions in which a low voltage test circuit is connected to each pilot light through separate terminals, and the signal circuit voltage is fed to the lamp through a transformer with isolation diodes in the transformer secondary. Such construction requires an extra transformer and leads in the control circuit, which diminishes its acceptance in the industrial control industry.

In another form of commercial pilot light, the contacts of an electromechanical relay are placed between the signal terminal and the test terminal to isolate one from the other, and the relay coil is connected between the test terminal and a common line terminal. A relay allows for the insertion of a transformer with the primary being switched between the signal and test terminals, and the low voltage secondary being connected to the lamp. Relays, however, are subject to mechanical failure by reason of contact breakage or wear of parts, or such malfunctions as contact welding or opening of the operating coil circuit. It is desirable to eliminate reliance on such a mechanical operation, and an alternative use of properly tested solid state circuit components could provide long and reliable life.

SUMMARY OF THE INVENTION

The present invention resides in a pilot light having a signal circuit for connection to a device to be monitored, a test circuit for connection to an external test switch, and a lamp circuit in optically coupled relation to both said signal and test circuits.

By use of light coupling between the lamp circuit and both the signal and test circuits the current illuminating the lamp becomes separate from the currents in the other circuits. This distinguishes from prior art pilot lights in which one, or both of the signal and test circuit currents passes through the lamp, or a transformer feeding the lamp, in order to illuminate the lamp. Through such isolation of the lamp, by means of light coupling between circuits, lamp voltage cannot cause energization of devices in the circuit being monitored.

Isolation of the lamp circuit enables the signal and test circuits within the pilot light to each be connected between its respective signal or test terminal and a common return line terminal, so that these two circuits may operate independently of one another. Then in the event of a malfunction, such as a shorting of components in one circuit, energization of the other circuit will feed unwanted currents into the malfunctioning circuit, as may be the case in some pilot lights using diode isolation.

A further advantage of isolating the lamp circuit from the signal and test circuits is that the power requirements of the signal and test circuits can be materially reduced. In prior devices the current for illuminating the lamp passes through the signal and test terminals, and the components isolating them from one another, but by isolation of the lamp circuit, the signal or test circuits need not handle the power for illuminating the lamp. As a result, the signal and test circuits of the pilot light have very small current requirements, merely enough to activate the light emitting elements that form a part of these circuits. Light emission is all that is required of these circuits, and the light then triggers operation of the lamp circuit. The lamp circuit includes photodetectors which cause current amplifying transistors to conduct, and the transistors are in circuit with the lamp to draw lamp current from a voltage source separate from the test and signal circuits. As a result of this construction utilizing light coupling between circuits, the currents in the signal and test circuits become so small they are unanble to operate any element of an associated control circuit being monitored, if a malfunction were to occur in the pilot light. A uniquely protective circuit is thus provided by the invention.

Objects of the invention include:

1. Utilization of light coupling between a lamp circuit and signal and test circuits within a remote test type of pilot light.

2. Reduction of the power handled by the signal and test circuits of a pilot light.

3. Elimination of mechanical operations in remote test pilot lights.

The foregoing and other objects and advantages of the invention will appear from the following description. In the description, reference is made to the accompanying drawings, which form a part hereof, and in which there is shown by way of illustration and not of limitation preferred embodiments of the invention. Such embodiments do not represent the full scope of the invention, and reference is made to the claims herein for interpreting the breadth of the invention.

DESCRIPTION OF PREFERRED EMBODIMENTS

Figure 1:
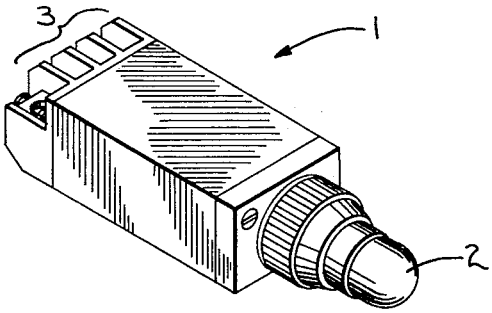
FIG. 1 is a view in perspective of a pilot light in which the present invention may be embodied.
Figure 2:
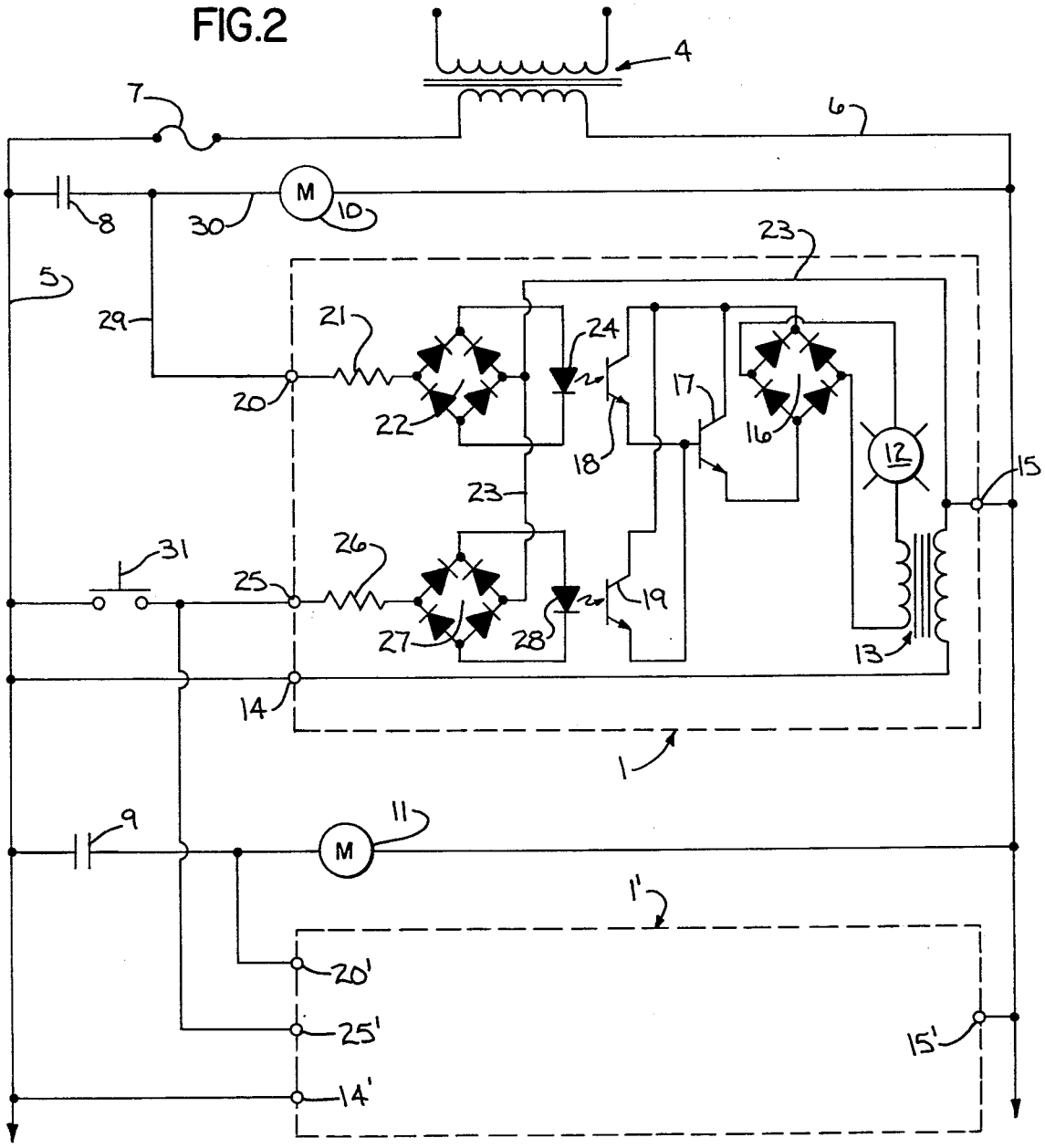
FIG. 2 is a schematic wiring diagram including the circuit of a pilot light embodying the invention.

Referring to FIG. 1 of the drawings, there is shown a pilot light 1 having an external configuration that is typical of pilot lights used in monitoring industrial control circuits. The pilot light 1 has a rectangular body with a lens 2 projecting from one end that encloses an incandescent lamp, and at the other end there is a set of terminals 3, for making connections into a control circuit. A simplified example of a control circuit, with which a number of pilot lights 1 may be associated, is schematically shown in FIG. 2. Power for this control circuit is supplied through an input transformer 4 that steps voltage down to the level of the control circuit. The secondary winding of the transformer 4 is connected to control circuit lines 5 and 6, and an overload protective device 7 such as a fuse or circuit breaker is inserted between the transformer secondary winding and the line 5. For purposes of illustration, a pair of switch contacts 8 and 9 are shown which are operated to energize the windings of a pair of associated motors 10 and 11. Upon closure of the switch contacts 8 the motor 10 is energized between lines 5 and 6, and upon closure of the switch contacts 9 the motor 11 is similarly energized. These switches 8, 9 and the motors 10, 11 may take a myriad number of forms and arrangements, as is known in the industrial control circuit art, and as a simple illustration the switch contacts 8 might be those of a manual switch and the motor 10 might be a fan motor that is started and stopped upon closing and opening the switch contacts 8. The switch contacts 9 could be those of an electromagnetically operated across the line motor starter, and the motor 11 could drive a machine tool, conveyor belt, pump or some other device. A typical control circuit would also include a larger number of switching devices and circuit components that are controlled thereby, and it is commonly desirable to monitor the operation of large numbers of switches and devices controlled thereby by connecting numerous pilot lights into the circuit that provide a visual indication of control circuit operation. In FIG. 2 only a pair of pilot lights 1 are shown for purposes of describing the invention embodied in these lights and their interplay with the control circuit, and the simple block outline for the lower pilot light 1' indicates it is of the same construction as the upper pilot light 1.

Referring to the upper pilot light 1 of FIG. 2, for which the full circuit is shown, one side of a lamp 12, that fits inside a lens cap 2, is connected to the secondary winding of a step down transformer 13. The transformer primary is connected between an input terminal 14 and a line terminal 15. Input terminal 14 is connected to the control circuit line 5 and the line terminal 15 is connected to the control circuit line 6, so as to provide an input voltage for the transformer 13. The lamp 12 is connected is series with one input side of a bridge rectifier 16, and the opposite input side of the rectifier 16 is joined to the secondary winding of the transformer 13, so that current flowing through the rectifier 16 also passes through and illuminates the lamp 12. The rectifier 16 is comprised of four diodes in usual bridge configuration, and the output side of the rectifier 16 is in parallel with the collector and emitter of a current amplifying transistor 17. A light responsive photodetector 18 is connected across the base and collector of the transistor 17, so that current from the detector 18 will cause the transistor 17 to conduct. A second photodetector 19 is connected in parallel with the photodector 18, so as also to be across the base and collector of the transistor 17.

A signal terminal 20 for the pilot light 1 connects through a resistor 21 to one input side of a bridge rectifier 22, and the opposite input side of the rectifier 22 is connected through a lead 23 to the line terminal 15. Across the output side of the rectifier 22 is a light emitting diode 24 that is positioned to cast its light upon the photodetector 18.

A test terminal 25 for the pilot light 1 is joined through a resistor 26 to one side of a bridge rectifier 27, and the other input side of the rectifier 27 is connected through the lead 23 to the line terminal 15. The output side of the rectifier 27 is connected to a light emitting diode 28 that casts its light upon the photodetector 19.

To connect the pilot light into the control circuit of FIG. 2, the signal terminal 20 is connected through a lead 29 to a lead 30 that extends between the switch contacts 8 and the motor 10. The test terminal 25 is connected to one side of a manually operable, normally open, test button 31, which has its opposite side joined to the control circuit line 5, and the line terminal 15 is connected to the control circuit line 6 as previously noted. The lower pilot light 1', which is merely represented by a blocked out area, is constructed the same as the pilot light 1 and is connected into the control circuit in similar fashion, with a line terminal 15' connected to the control circuit line 6, a signal terminal 20' connected to a point between the switch contacts 9 and the motor 11, a test terminal 25' connected through the push button 31, and an input terminal 14' connected to the control circuit line 5.

It is the function of the pilot light 1 to illuminate its lamp 12 upon a closure of the switch contacts 8, so as to indicate that such switch is closed and that the motor 10 should be running. The closure of the switch contacts 8 applies control voltage appearing between the lines 5 and 6 across the pilot light signal terminal 20 and the line terminal 15. The line voltage is then applied across the resistor 21 and the input side of the bridge rectifier 22, whereby the bridge rectifier 22 will feed its direct current output through the light emitting diode 24. The diode 24 then is activated so as to cast a light upon the photodetector 18.

Current will now flow through the photodetector 18, and this causes the transistor 17 to conduct and draw current from the bridge rectifier 16, which has been in a state of readiness with its input side connected across the secondary side of the transformer 13. Current drawn through the rectifier 16 flows through and illuminates the lamp 12 to indicate the switch contacts 8 are closed. Thus, the small current that flows through the photodetector 18 is amplified by the transistor 17 to draw sufficient current through the rectifier 16 to cause the lamp 12 to burn brightly for monitoring, or indicating a control circuit condition.

If at any time an operator wishes to know whether the lamp 12 is operable, and not burned out, the pushbutton 31 is closed. This applies control line voltage across the test terminal 25 and the line terminal 15. Light emitting diode 28 now draws current through the rectifier 27 which is limited in amount by the resistor 26. The light emitting diode 28 activates the photodetector 19, which turns on the transistor 17. The lamp 12 is now illuminated in the same manner as when the photodetector 18 was activated. Thus, a test is provided for checking the integrity of the lamp 12, and this test can be made while the lamp 12 is simultaneously illuminated by the signal circuit without injury to the lamp. This enables a plurality of pilot lights to be tested while the control circuit is active and some lamps are illuminated while others are not. For example, closure of pushbutton 31 will apply a test voltage to both pilot lights 1 and 1' to conduct the test operation regardless of whether either of the pilot lights 1, 1' has its signal terminal 20, 20' energized by operation of the associated contacts 8, 9.

By the use of light emitters and photodetectors the lamp circuit supplying power for illuminating the lamp 12 (including the transformer 13, bridge rectifier 16, photodetectors 18, 19, and transistor 17) is isolated from both the pilot light signal circuit (including the resistor 21, bridge 22 and light emitting diode 24) connected to the signal terminal 20 and the pilot light test circuit (including the resistor 26, bridge 27 and the light emitting diode 28) connected to the test terminal 25. This isolation permits the currents drawn in the signal and test circuits to be very small, and in a typical application the resistors 21 and 26 may each be of the value of 22,000 ohms to limit current and draw only approximately 5 milliamperes in the signal and test circuits when used with a control circuit voltage of 110 volts between the lines 5 and 6. Such a current is small compared to that drawn by the motors 10, 11 and cannot effect an operation of such control circuit components.

The isolation of the signal and test circuits from the lamp circuit also enables each of the signal and test circuits to be connected by itself between the line terminal 15 and the respective signal terminal 20 or test terminal 25. As a result, if one of these circuits was to become shorted no current will circulate through the circuit from the other circuit. Independence of the several pilot light circuits is thus achieved.

The transformer 13 provides for a low voltage lamp 12. Maintenance personnel can remove a lens cap 2 and replace a lamp without disconnecting or interrupting the operation of the pilot light 1 or the control circuit into which it is wired. The transformer 13 can be eliminated if it is desired to dispense with the bulk of a transformer, and a higher voltage lamp is satisfactory. The transformer 13 can have its circuit connections modified if desired by placing the primary winding of the transformer 13 in series with the bridge rectifier 16 and connecting the lamp 12 as the only element across the secondary of the transformer.

Figure 3:
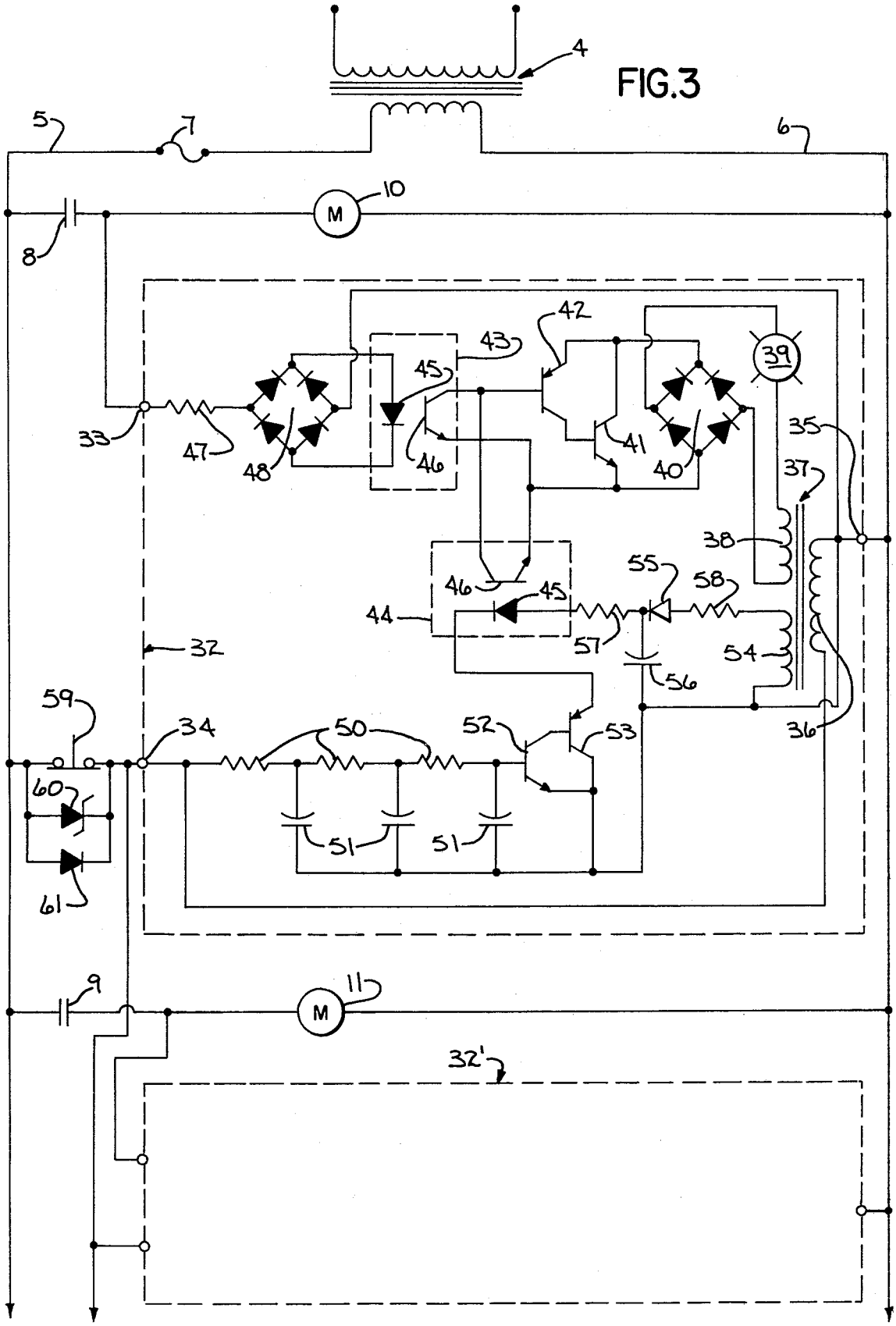
FIG. 3 is a second schematic wiring diagram including the circuit of a pilot light comprising a second embodiment of the invention.

Referring now to the embodiment of FIG. 3, there is shown a pair of like pilot lights 32 and 32' connected into a control circuit that is similar to that in FIG. 2. With the exception of a test button, the control circuit elements in FIG. 3 have been numbered the same as for FIG. 2 to indicate the likeness between the circuits. The circuit of the pilot light 32 has a set of three terminals comprising a signal terminal 33, a test terminal 34 and a line terminal 35. Connected across the test terminal 34 and line terminal 35 is the primary winding 36 of an input transformer 37. A first secondary winding 38 of the transformer 37 is connected to a lamp 39 and the input side of a bridge rectifier 49, the lamp 39 and rectifier 40 being in series with one another. The output side of the bridge rectifier 40 is connected to a pair of amplifying transistors 41 and 42, and connected across the base of the transistor 42 and the emitter of the transistor 41 are the outputs of a pair of opto-isolators 43 and 44. The opto-iolators 43 and 44 have their outputs in parallel with one another, and each of these isolators includes a light emitting element 45 and a photodetector 46. The opto-isolators 43 and 44 provide isolation between the lamp circuit and each of the signal and test circuits, similarly as the light emitting diodes 24, 29 and photodetectors 18 and 19 of the pilot light 1 of FIG. 2 isolated its lamp circuit from the other circuits.

The signal terminal 33 is connected through a resistor 47 to one side of the input of a bridge rectifier 48, and the other input side of the rectifier 48 is connected through a lead 49 to the line terminal 35. The output side of the bridge rectifier 48 is connected across the light emitting element 45 of the opto-isolator 43, and the signal circuit within the pilot light 32 is therefore similar to that of the pilot light 1 of FIG. 2.

The test circuit within the pilot light 32 differs substantially from that of the pilot light 1. The test terminal 34 is connected to a filter comprising a group of three resistors 50 and three capacitors 51 which functions to smooth a d.c. component that is fed to the test terminal 34 during testing of the lamp 39, as will be described hereinafter. The output of the filter is connected across the base and emitter of a transistor 52, and the transistor 52 is cascaded with a transistor 53. A secondary winding 54 of the transformer 37 is joined across a group of elements which provide rectification and filtering to have a d.c. output from the transformer. These elements comprise a diode 55, a capacitor 56 and two resistors 57 and 58. The d.c. output of these elements is connected to the light emitting element of the opto-isolator 44 and the trasistor 53. Thus, the test circuit of the pilot light 32 comprises a filter, d.c. power source, a light emitting element, and current amplifying transistors.

For testing the lamp 39 there is provided a normally closed test button 59 connected between the control circuit line 5 and the test terminal 34. Across the normally closed contacts of the test button 59 is a zener diode 60 and a diode 61, which are parallel with one another. When the test button 59 is in its normal, closed condition a.c. line voltage is applied at test terminal 34 of equal half cycles, so that no d.c. voltage component is applied to the filter circuit comprising resistors 50 and capacitors 51, wherefore transistors 52 and 53 remain nonconducting. The opto-isolator 44 remains inactive, and the lamp 39 consequently responds only to the opto-isolator 43 which is activated whenever the signal terminal 33 is energized by closure of the switch contacts 8. A signal voltage at the terminal 33 causes the element 45 to emit light and the element 46 conducts to trigger the transistors 41, 42 and draw lamp current through the rectifier 40, similarly as in the operation of pilot light 1 of FIG. 2.

If it is desired to test the lamp 39 the test button 59 is depressed to open its contacts. Then, during one-half of the a.c. cycle appearing across the control circuit lines 5, 6 the zener diode 60 will conduct with a slight reduction of the a.c. wave, and during the other half cycles the diode 61 will conduct without the same degree of diminishment of the a.c. wave. As a result, a net d.c. component is applied to the filter circuit comprising the resistors 50 and capacitors 51. This applies a filtered d.c. component to the base of the transistor 52 and the transistors 52 and 53 will now conduct with the transistor 53 functioning as a current amplifying element. Current will then flow from the d.c. power supply on the output side of the transformer secondary winding 54 through the light emitting element 45 of the opto-isolator 44, which in turn causes the photodetecting element 46 to conduct and apply the output thereof to the cascaded transistors 41 and 42. Current then flows through the transistor 41 so as to provide an illuminating current for the lamp 39. The lamp 39 is thus tested by operation of the test button 59. Also, as in the embodiment of FIG. 1 the power and current requirements of the pilot light signal and test circuits is small compared to the lamp circuit and associated control circuit being monitored.

The pilot light 32' is like and functions the same as the pilot light 32. Hence, upon depression of the test button 59 simultaneous testing is carried out for the lamps of both pilot lights 32 and 32'. Additional pilot lights also can be connected to the test button 59 for simultaneous testing of a number of pilot lights, and each pilot light uses solid state components with isolation between the lamp and signal and test circuits. Further, signal and test circuits have very small current requirements that cannot influence control circuit components such as a winding for a motor starter or the like.

Figure 4:
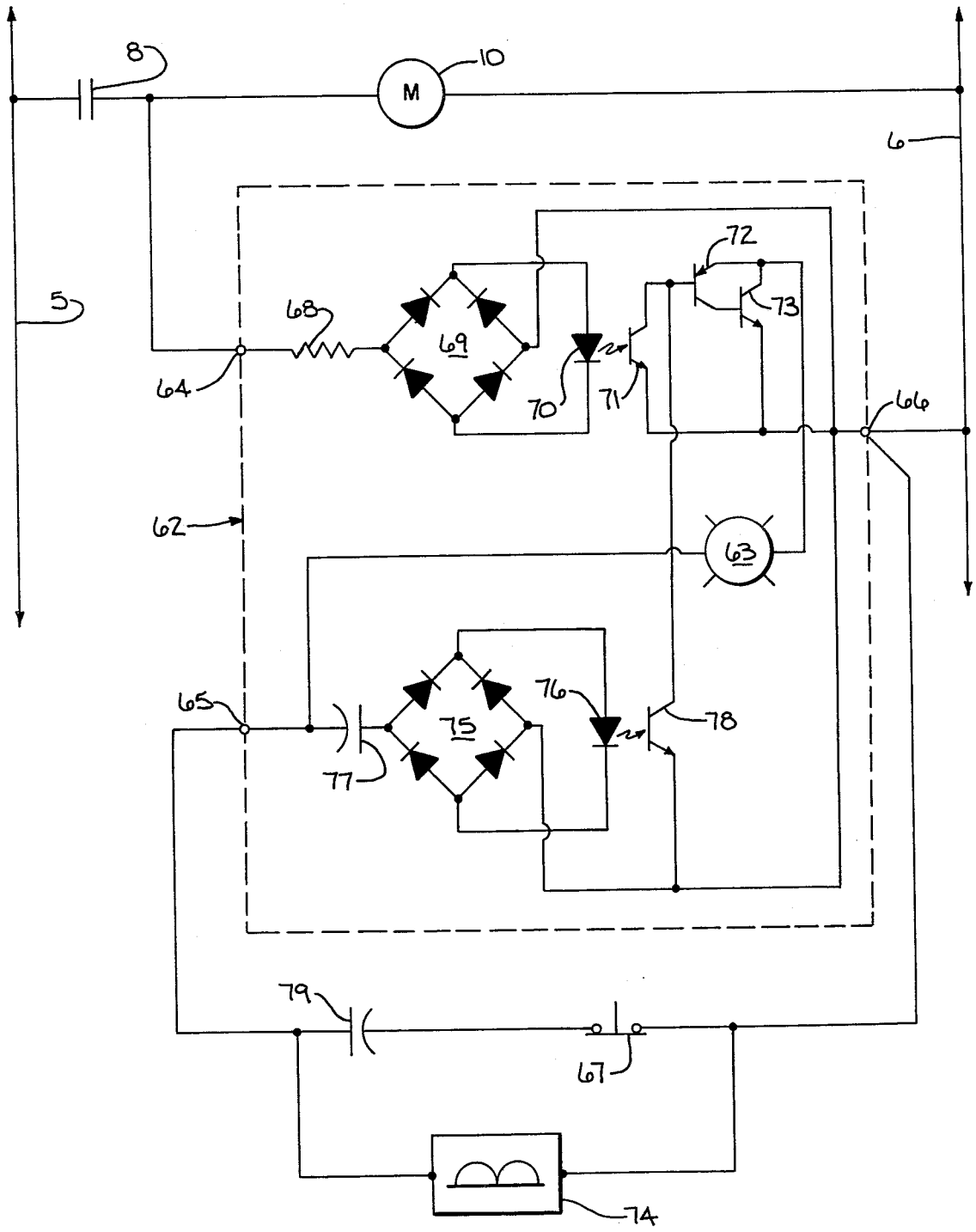
FIG. 4 is a third schematic wiring diagram of a circuit of a pilot light comprising a third embodiment of the invention.

Referring now to the third embodiment shown in FIG. 4, there is a pilot light 62 having a lamp 63 and a set of three terminals comprising a signal terminal 64, a test terminal 65 and a line terminal 66. A portion of a control circuit is depicted in association with the pilot light 62 that includes lines 5 and 6, a motor control switch 8 and a motor winding 10. It is to be understood that the control circuit includes additional circuit components operated off the lines 5, 6 and that additional pilot lights 62 will be incorporated into the circuitry to monitor the various circuit components, as in the other embodiments of the invention. All of the pilot lights 62 will be tested by a common test button 67.

The pilot light 62 has a signal circuit joined between the signal terminal 64 and line terminal 66 that includes a current limiting resistor 68, a rectifier 69 and a light emitting diode 70. The diode 70 is light coupled to a photodetector 71 in a lamp circuit that turns on a pair of cascaded current amplifying transistors 72, 73 when activated by the light source 70. The transistor 73 is in series with lamp 63 and the terminals 65, 66 which are connected across a pulsating d.c. source 74. The lamp 63 can then be illuminated, and the d.c. source determines lamp voltage. Hence, a low voltage lamp can be used without the need of a step down transformer.

The test circuit of the pilot light 62 is similar to the signal circuit, having a bridge rectifier 75 and a light emitting diode 76. It also includes a capacitor 77, which differs from the resistor 68 of the signal circuit. A photodetector 78 in the lamp circuit activates the cascaded transistors 72, 73 to operate the lamp 63. As in the other embodiments of the invention, the lamp circuit comprising the lamp 63, photodetectors 71, 78, and transistors 72, 73 is physically isolated from the signal and test circuits by the employment of light coupling between circuits.

The circuit of FIG. 4 differs principally from those of FIGS. 2 and 3 by provision of a d.c. voltage for connection to the test terminal 65 and line terminal 66. The d.c. source 74 is a pulsating one, and the pulsations are smoothed by a capacitor when the test switch 67 is in its normally closed position. The d.c. voltage applied to the terminals 65, 66 is blocked by the capacitor 77, and there is no energization of the test circuit. However, when the test button 67 is depressed for testing the condition of the lamp 63 the smoothing capacitor 79 is disabled, and a pulsating voltage is then applied to the terminals 65, 66. The capacitor 77 then passes the pulsations and diode 76 becomes a light emitter to activate the lamp circuit and test the lamp 63.

The invention in its several forms isolates a lamp circuit of a pilot light from signal and test circuits. The signal and test circuits become low power circuits and any failure in the circuitry of the pilot light should have no effect upon control circuits being monitored. Also, solid state components can be used exclusively and, if desired, a three terminal pilot light configuration can be adopted for the practice of the invention.

I claim:

1. In a pilot light the combination comprising:

a signal circuit having a light emitter;

a test circuit having a light emitter; and a lamp circuit with light responsive means in light receiving relation to said light emitters that causes lamp circuit conduction.

2. In a pilot light the combination comprising:

a signal circuit having a current limiting element and a light emitter connected between a signal terminal and a line terminal;

a test circuit having a current limiting element and a light emitter connected between a test circuit terminal and said line terminal; and a lamp circuit having a lamp, light responsive means and current amplification means connected across said line terminal and one other terminal, said light responsive means being in light receiving relation to said light emitters, and said current amplification means being between said light responsive means and said lamp.

3. A pilot light as in claim 2 wherein said lamp circuit is between said line terminal and a fourth terminal.

4. A pilot light as in claim 2 wherein said lamp circuit is between said line terminal and said signal terminal.

5. In a pilot light the combination comprising:

a lamp circuit having a lamp and a bridge rectifier across a voltage input, and further having photodetector means and a current amplifier connected across said bridge rectifier;

a signal circuit having a current limiting resistor and a rectifier feeding a light emitting element in light coupling relation to said photodetector means;

a test circuit having a current limiting resistor and a rectifier feeding a light emitting element in light coupling relation to said photodetector means; and a set of terminals for connecting said signal circuit to a device to be monitored, said test circuit to a test switch, and said lamp circuit to a voltage supply.

6. A pilot light as in claim 5 having a transformer in said lamp circuit with a low voltage winding connected to said lamp.

* * * * *

UNITED STATES PATENT AND TRADEMARK OFFICE

CERTIFICATE OF CORRECTION

PATENT NO. : 4,449,076

DATED : May 15, 1984

INVENTOR(S) : Enoch P. Smith

It is certified that error appears in the above-identified patent and that said Letters Patent is hereby corrected as shown below:

Column 2, line 53, "will feed" should be --will not feed--.

Column 3, line 8, "unanable" should be --unable--.

Column 4, line 30, "is" should be --in--.

Column 6, line 35, "rectifier 49" should be --rectifier 40--.

Signed and Sealed this

*Second* Day of *October 1984*

[SEAL]

*Attest:*

GERALD J. MOSSINGHOFF

*Attesting Officer*

*Commissioner of Patents and Trademarks*